US009618951B2

(12) United States Patent
Kobayashi et al.

(10) Patent No.: US 9,618,951 B2
(45) Date of Patent: Apr. 11, 2017

(54) VOLTAGE REGULATOR

(71) Applicant: Seiko Instruments Inc., Chiba-shi, Chiba (JP)

(72) Inventors: Yuji Kobayashi, Chiba (JP); Manabu Fujimura, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 50 days.

(21) Appl. No.: 14/512,732

(22) Filed: Oct. 13, 2014

(65) Prior Publication Data

US 2015/0102789 A1 Apr. 16, 2015

(30) Foreign Application Priority Data

Oct. 15, 2013 (JP) ..... 2013-214936

(51) Int. Cl.
*G05F 1/56* (2006.01)
*G05F 1/46* (2006.01)
*G05F 1/567* (2006.01)

(52) U.S. Cl.
CPC ..... *G05F 1/56* (2013.01); *G05F 1/468* (2013.01); *G05F 1/567* (2013.01)

(58) Field of Classification Search
CPC ..... H02M 3/158; G05F 1/468; G05F 1/56; G05F 1/567
See application file for complete search history.

(56) References Cited

U.S. PATENT DOCUMENTS 7,319,314 B1 * 1/2008 Maheshwari ..... G05F 1/46 323/313
2002/0057125 A1 * 5/2002 Demizu ..... H02M 3/156 327/538
2007/0216461 A1 * 9/2007 Morino ..... H01L 27/0248 327/287
2009/0206807 A1 * 8/2009 Imura ..... G05F 1/573 323/277
2009/0278518 A1 * 11/2009 Takagi ..... G05F 1/56 323/282
2013/0038314 A1 * 2/2013 Nakashima ..... H02M 3/158 323/304
2014/0203791 A1 * 7/2014 Lee ..... G05F 1/468 323/282

FOREIGN PATENT DOCUMENTS

JP 9-326469 A 12/1997

* cited by examiner

*Primary Examiner* — Jessica Han
*Assistant Examiner* — Bart Iliya
(74) *Attorney, Agent, or Firm* — Brinks Gilson & Lione

(57) ABSTRACT

Provided is a voltage regulator capable of keeping the accuracy of an output voltage thereof even at high temperature. The voltage regulator includes: a reference voltage circuit configured to output a reference voltage; an output transistor configured to output an output voltage; a voltage divider circuit configured to divide the output voltage to output a divided voltage; an error amplifier circuit configured to amplify a difference between the reference voltage and the divided voltage, and output the amplified difference to control a gate of the output transistor; a switching circuit configured to switch the divided voltage of the voltage divider circuit; and a temperature detection circuit configured to output a signal in accordance with temperature to control the switching circuit.

3 Claims, 9 Drawing Sheets

VOLTAGE REGULATOR

RELATED APPLICATIONS

This application claims priority under 35 U.S.C. §119 to Japanese Patent Application No. 2013-214936 filed on Oct. 15, 2013, the entire content of which is hereby incorporated by reference.

BACKGROUND OF THE INVENTION

1. Field of the Invention

The present invention relates to a voltage regulator including a voltage divider circuit capable of reducing an influence of a leakage current flowing at high temperature to keep the accuracy of an output voltage of the voltage regulator.

2. Description of the Related Art

A related-art voltage regulator is now described. FIG. 9 is a circuit diagram illustrating the related-art voltage regulator.

A differential amplifier circuit 104 compares a reference voltage VREF output from a reference voltage circuit 103 and a feedback voltage VFB output from a voltage divider circuit 106, and controls a gate voltage of an output transistor 105 so that the reference voltage VREF and the feedback voltage VFB have the same value. When an output voltage of an output terminal 102 is represented by VOUT, the output voltage VOUT is obtained by the following expression.

$$VOUT=(RS+RF)/RS\times VREF \quad (1)$$

where RF represents the resistance value of a resistor 121 and RS represents the resistance value of a resistor 122.

The reference voltage circuit 103 includes an Nch depletion transistor 131 and an NMOS transistor 132, and is controlled to keep the accuracy of the output voltage VOUT with respect to temperature (for example, see Japanese Patent Application Laid-open No. Hei 9-326469).

When the voltage regulator enters such a high temperature state that the NMOS transistor 132 and the Nch depletion transistor 131 that form the reference voltage circuit 103 cause a junction leakage current and a channel leakage current to flow, the reference voltage VREF is decreased due to the influence of the leakage currents (see FIG. 8A). Thus, the related-art voltage regulator has a problem in that the accuracy of the output voltage VOUT cannot be kept within a certain range at high temperature.

SUMMARY OF THE INVENTION

The present invention has been made in view of the problem described above, and provides a voltage regulator capable of keeping the accuracy of an output voltage VOUT of the voltage regulator even when a reference voltage VREF is decreased due to the influence of a leakage current.

In order to solve the problem of the related art, a voltage regulator according to one embodiment of the present invention has the following configuration.

Specifically, there is provided a voltage regulator, including: a reference voltage circuit configured to output a reference voltage; an output transistor configured to output an output voltage; a voltage divider circuit configured to divide the output voltage to output a divided voltage; an error amplifier circuit configured to amplify a difference between the reference voltage and the divided voltage, and output the amplified difference to control a gate of the output transistor; a switching circuit configured to switch the divided voltage of the voltage divider circuit; and a temperature detection circuit configured to output a signal in accordance with temperature to control the switching circuit.

According to the voltage regulator including the voltage divider circuit of one embodiment of the present invention, even when the leakage current flows at high temperature to decrease the reference voltage, the resistance value of the voltage-dividing resistor connected to the output terminal can be changed to increase the output voltage VOUT. Thus, the accuracy of the output voltage VOUT can be kept within a certain range.

DETAILED DESCRIPTION OF THE PREFERRED EMBODIMENTS

First Embodiment

Figure 1:
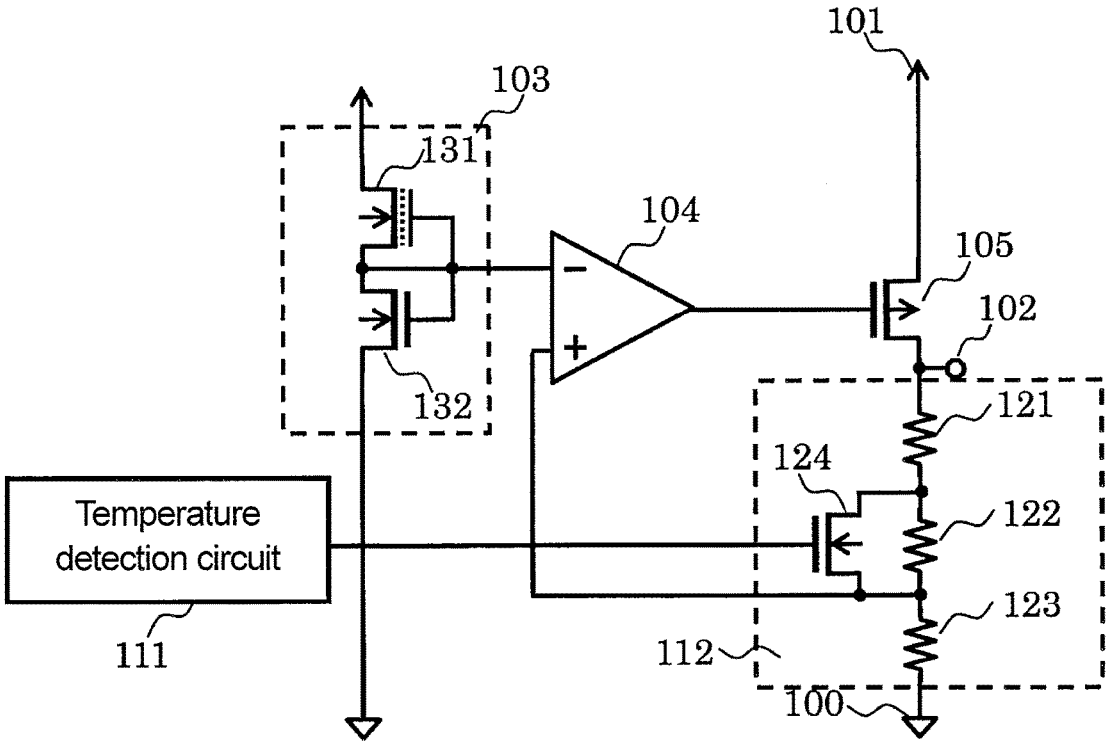
FIG. 1 is a schematic diagram illustrating a voltage regulator according to a first embodiment of the present invention.

FIG. 1 is a schematic diagram illustrating a voltage regulator according to a first embodiment of the present invention. The voltage regulator of the first embodiment includes a reference voltage circuit 103, a differential amplifier circuit 104, an output transistor 105, a voltage divider circuit 112, a temperature detection circuit 111, a ground terminal 100, a power supply terminal 101, and an output terminal 102. The reference voltage circuit 103 includes, for example, an Nch depletion transistor 131 and an NMOS transistor 132. The voltage divider circuit 112 includes resistors 121, 122, and 123 and an NMOS transistor 124.

The differential amplifier circuit 104 has an inverting input terminal connected to an output terminal of the reference voltage circuit 103, a non-inverting input terminal connected to an output terminal of the voltage divider circuit 112, and an output terminal connected to a gate of the output transistor 105. The output transistor 105 has a source connected to the power supply terminal 101, and a drain connected to the output terminal 102. The voltage divider circuit 112 includes the resistor 121, the resistor 122, and the resistor 123 connected in series between the output terminal 102 and the ground terminal 100, and the NMOS transistor 124 connected in parallel to the resistor 122. The temperature detection circuit 111 has an output terminal connected to a gate of the NMOS transistor 124.

Next, the operation of the voltage regulator of the first embodiment is described.

An output voltage of the reference voltage circuit 103 at normal temperature is represented by VREF. At normal temperature, the temperature detection circuit 111 outputs a signal High to turn on the NMOS transistor 124. Accordingly, the resistors 121 and 123 form the voltage divider circuit 112.

At high temperature, the output voltage of the reference voltage circuit 103 decreases due to influences of the junction leakage current and the channel leakage current of the transistors. Then, the temperature detection circuit 111 outputs a signal Low to turn off the NMOS transistor 124. Accordingly, the resistors 121, 122, and 123 form the voltage divider circuit 112. At this time, an output voltage VOUT of the output terminal 102 is expressed by Expression (2).

$$VOUT=(RS+RF+RA)/RS\times VREFH \quad (2)$$

where RS represents the resistance value of the resistor 123, RF represents the resistance value of the resistor 121, RA represents the resistance value of the resistor 122, and VREFH represents the output voltage of the reference voltage circuit 103 at high temperature. The resistance value of the voltage divider circuit 112 increases by the resistance value RA corresponding to a decreased amount of the reference voltage VREF due to a leakage current flowing at high temperature, and hence the decrease in output voltage VOUT can be cancelled out. It is desired that the resistance value RA satisfy the following condition.

$$RA/RS\times VREFH>(VREF-VREFH) \quad (3)$$

Figure 8A:
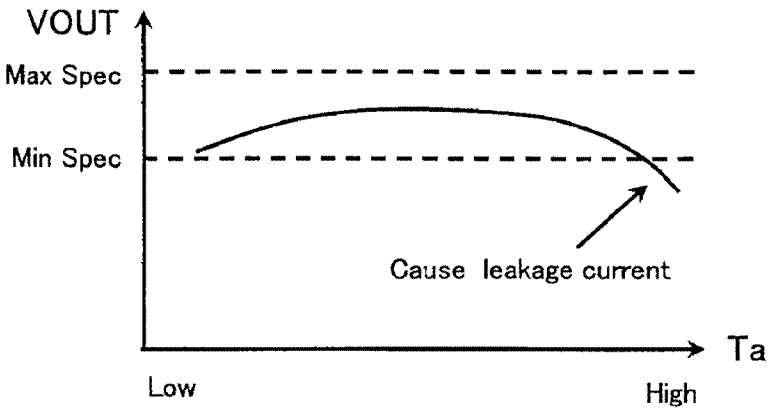
FIGS. 8A to 8D are graphs showing output voltages and temperature characteristics of the voltage regulator according to the embodiments and a related-art circuit.
Figure 8C:
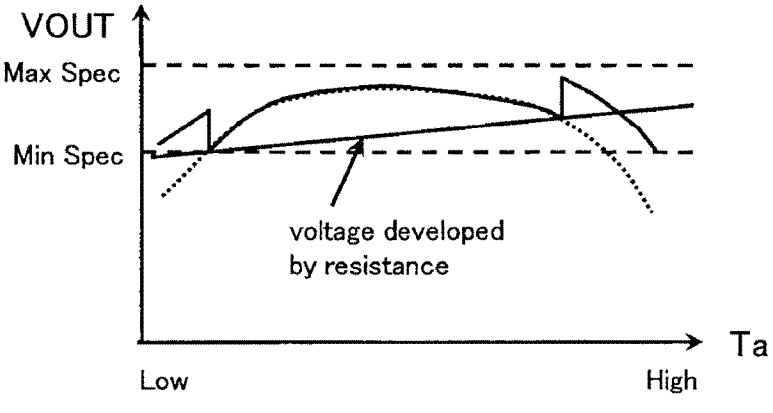
Figure 8B:
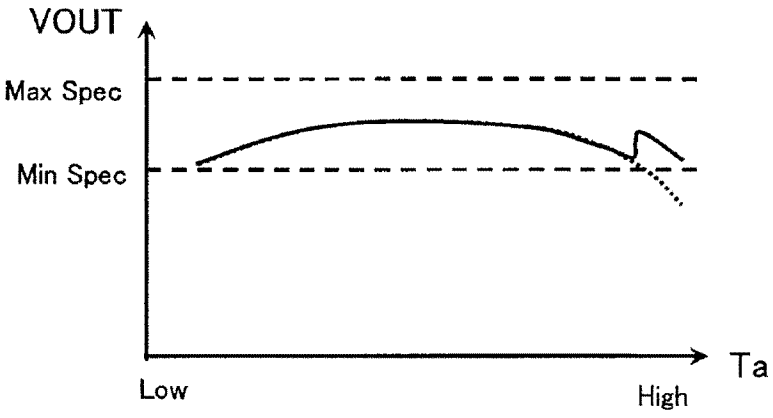

FIG. 8B shows the relationship between the output voltage VOUT of the voltage regulator of the first embodiment and temperature Ta. At high temperature, the temperature detection circuit 111 operates for detection to output a signal Low so that the output voltage VOUT increases and can be kept within a certain range.

Figure 2:
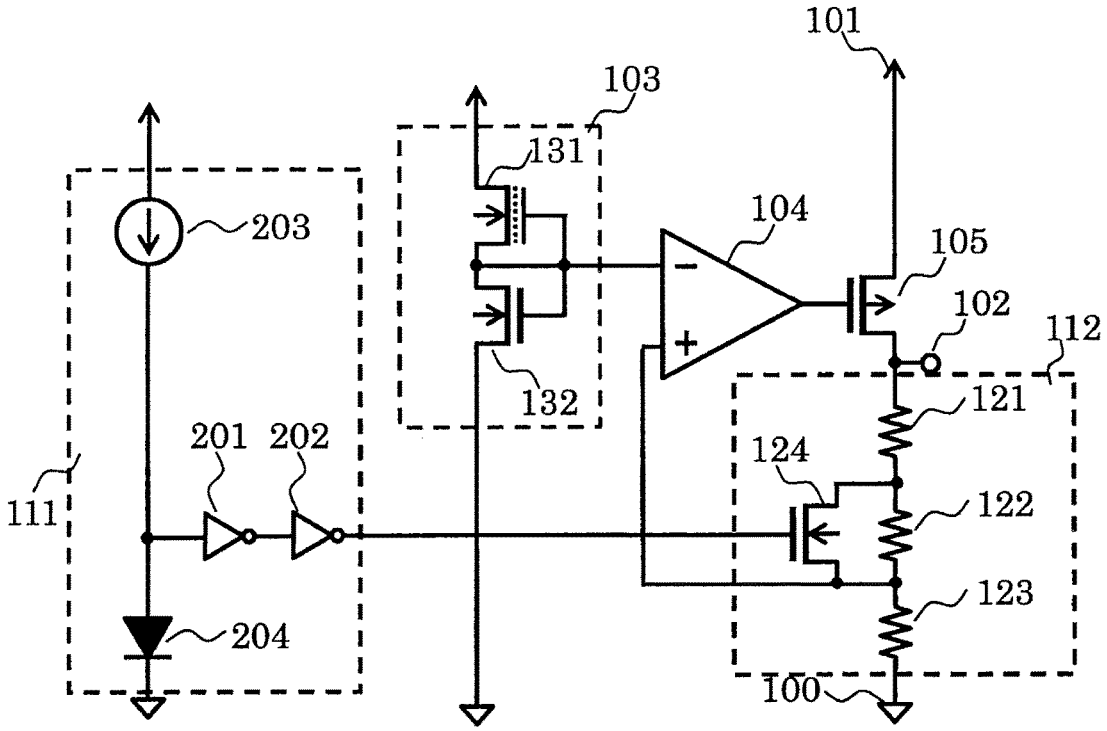
FIG. 2 is a circuit diagram illustrating an example of the voltage regulator of the first embodiment.

FIG. 2 is a circuit diagram illustrating the detailed configuration of the temperature detection circuit 111 of the voltage regulator according to the first embodiment. The temperature detection circuit 111 includes a constant current circuit 203, a diode 204, and inverters 201 and 202. The constant current circuit 203 has one terminal connected to the power supply terminal 101, and the other terminal connected to an input of the inverter 201 and an anode of the diode 204. A cathode of the diode 204 is connected to the ground terminal 100. The inverter 202 has an input connected to an output of the inverter 201, and an output connected to the gate of the NMOS transistor 124.

The operation of the temperature detection circuit 111 is now described. A constant current of the constant current circuit 203 is independent of temperature similarly to a current of a band-gap reference circuit, for example. A voltage across both ends of the diode 204 has a negative temperature coefficient of about −2 mV. Thus, at high temperature, when a voltage of the anode of the diode 204 decreases to be equal to or smaller than an inversion voltage of the inverter 201, the inverter 201 outputs a signal High and the inverter 202 outputs a signal Low. That is, the temperature detection circuit 111 outputs a signal Low at high temperature.

Note that, the NMOS transistor 124 and the resistor 122 may be connected to each other between the output terminal 102 and the resistor 121. Further, if a signal to be input to the gate of the NMOS transistor 124 is inverted, a PMOS transistor may be used as the NMOS transistor 124. Further, the reference voltage circuit 103 and the temperature detection circuit 111 may have any configuration as long as the operation of the present invention is achieved.

As described above, according to the voltage regulator of the first embodiment, even when the leakage current flows at high temperature to decrease the reference voltage VREF, the resistance value of the voltage divider circuit 112 can be increased to keep the accuracy of the output voltage VOUT within a certain range.

Figure 3:
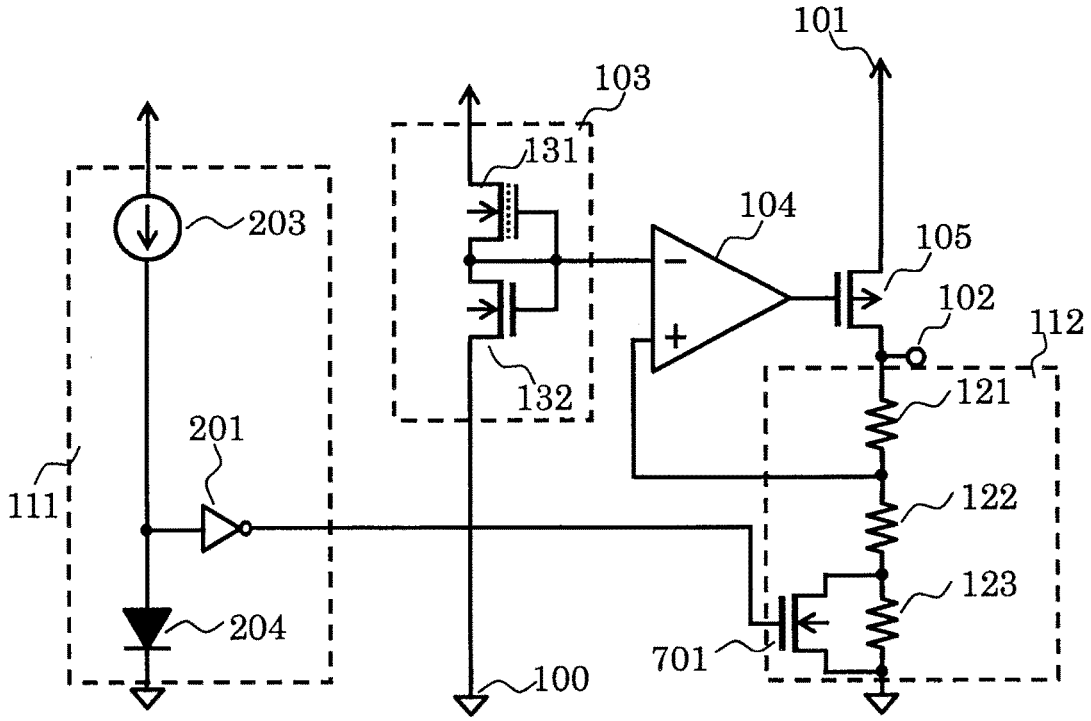
FIG. 3 is a circuit diagram illustrating another example of the voltage regulator of the first embodiment.

FIG. 3 is a circuit diagram illustrating another example of the voltage regulator of the first embodiment.

FIG. 3 differs from FIG. 2 in the following points. The voltage divider circuit 112 includes an NMOS transistor 701 connected in parallel to the resistor 123, and an output terminal as a node between the resistor 121 and the resistor 122. The inverter 201 forms an output stage of the temperature detection circuit 111, and the output terminal of the inverter 201 is connected to a gate of the NMOS transistor 701 as the output terminal of the temperature detection circuit 111.

The operation of the temperature detection circuit 111 is the same as that of FIG. 2 except for the output logic thereof. At high temperature, when the voltage across both ends of the diode 204 decreases to fall below a threshold of the inverter 201, the inverter 201 outputs a signal High as the output of the temperature detection circuit 111. Then, the NMOS transistor 701 of the voltage divider circuit 112 is turned on. The output voltage VOUT is expressed by Expression (6).

$$VOUT=(RA+RF)/RA\times VREFH \quad (6)$$

Therefore, a feedback voltage VFB decreases by a decreased amount of the reference voltage VREF of the reference voltage circuit 103 due to the influence of the leakage current so that the accuracy of the output voltage VOUT can be kept within a certain range.

Figure 4:
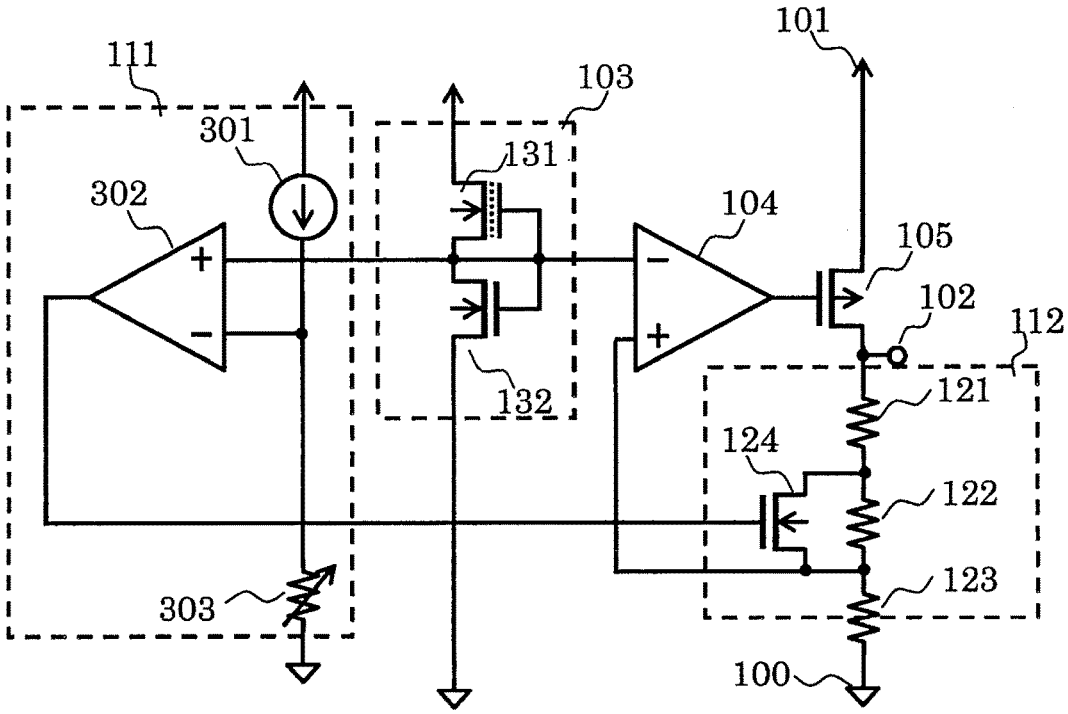
FIG. 4 is a circuit diagram illustrating still another example of the voltage regulator of the first embodiment.

FIG. 4 is a circuit diagram illustrating still another example of the temperature detection circuit 111 of the voltage regulator according to the first embodiment. The temperature detection circuit 111 includes a constant current circuit 301, a comparison circuit 302, and a resistor 303. The constant current circuit 301 has one terminal connected to the power supply terminal 101, and the other terminal connected to the resistor 303 and an inverting input terminal of the comparison circuit 302. The resistor 303 has one terminal connected to the inverting input terminal of the comparison circuit 302, and the other terminal connected to the ground terminal 100. The comparison circuit 302 has a non-inverting input terminal connected to the output of the reference voltage circuit 103, and an output terminal connected to the gate of the NMOS transistor 124.

A constant current of the constant current circuit 301 has a positive temperature coefficient similarly to, for example, a current of a circuit using a weak inversion region of a transistor or a PTAT circuit. The resistor 303 includes a resistor having a slightly negative temperature coefficient of, for example, about −100 ppm. With this configuration, a voltage across both ends of the resistor 303 can have a positive temperature coefficient. Further, with a configuration in which a resistor having a large negative temperature coefficient of, for example, about −4,000 ppm is used as the resistor 303, the voltage across both ends of the resistor 303 can have a negative temperature coefficient. The constant current of the constant current circuit 301 and the resistor 303 are set to be trimmable.

The temperature detection circuit 111 compares, by using the comparison circuit 302, the voltage across both ends of the resistor 303 having a positive temperature coefficient or a negative temperature coefficient and the output voltage of the reference voltage circuit 103. When the output voltage of the reference voltage circuit 103 falls below the voltage across both ends of the resistor 303, the output terminal of the comparison circuit 302 outputs a signal Low. Thus, by trimming the temperature coefficient of the voltage across both ends of the resistor 303, it is possible to directly detect not only the influence of the leakage current flowing at high temperature, but also temperature characteristics of the output terminal of the reference voltage circuit 103.

The operation of the voltage divider circuit 112 is the same as that of the first embodiment. Specifically, at high temperature, the temperature detection circuit 111 outputs a signal Low to turn off the NMOS transistor 124 and the resistor 123 is added to the resistor 121. In this way, the conditions of Expression (2) and Expression (3) are satisfied and the output voltage VOUT once increases so that the accuracy of the output voltage VOUT can be kept within a certain range. Further, at low temperature, when the output voltage of the reference voltage circuit 103 decreases, the temperature detection circuit 111 outputs a signal Low to turn off the NMOS transistor 124 and the resistor 123 is added to the resistor 121. In this way, the output voltage VOUT once increases so that the accuracy of the output voltage VOUT can be kept within a certain range. As shown in FIG. 8C, the output voltage VOUT once increases on the high temperature side and on the low temperature side.

Note that, the reference voltage circuit and the temperature detection circuit may have any configuration without limitation as long as the operation of the present invention is achieved.

As described above, according to the voltage regulator of the first embodiment, regardless of temperature, the resistance value of the voltage-dividing resistor connected to the output terminal can increase to increase the output voltage VOUT. Therefore, the accuracy of the output voltage VOUT can be kept within a certain range regardless of temperature.

Second Embodiment

Figure 5:
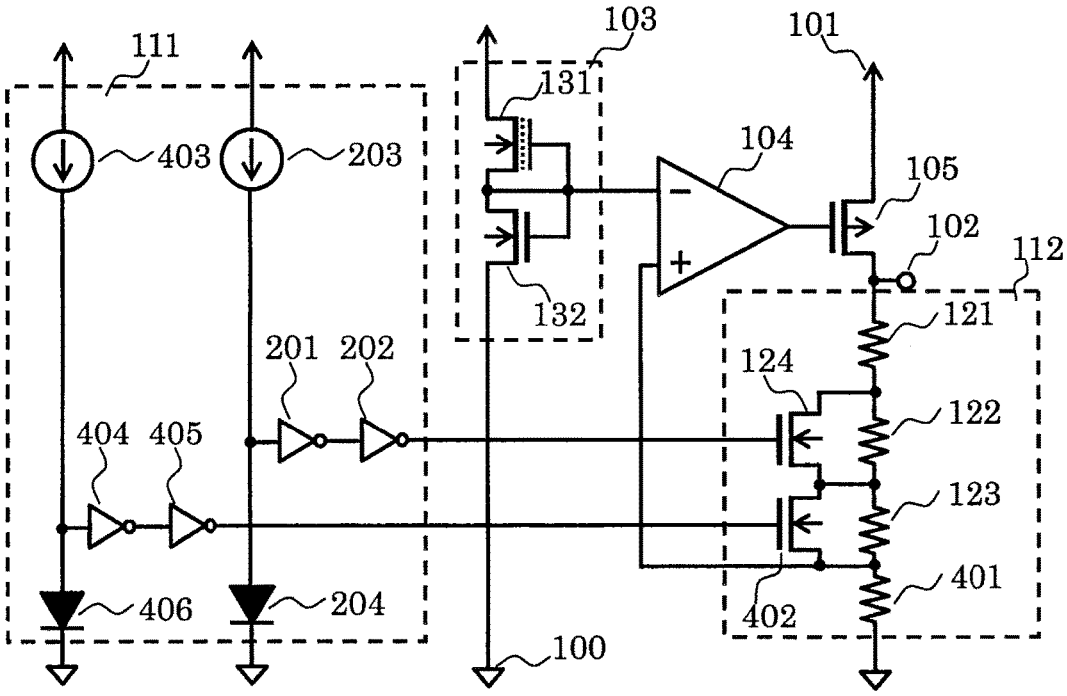
FIG. 5 is a circuit diagram illustrating an example of a voltage regulator according to a second embodiment of the present invention.

FIG. 5 is a circuit diagram illustrating an example of a voltage regulator according to a second embodiment of the present invention. The second embodiment differs from the first embodiment in that two temperature detection circuits are provided.

Figure 8D:
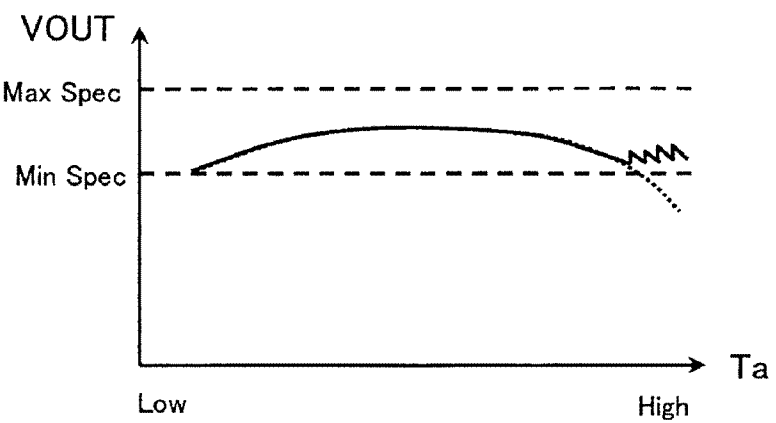
Figure 9:
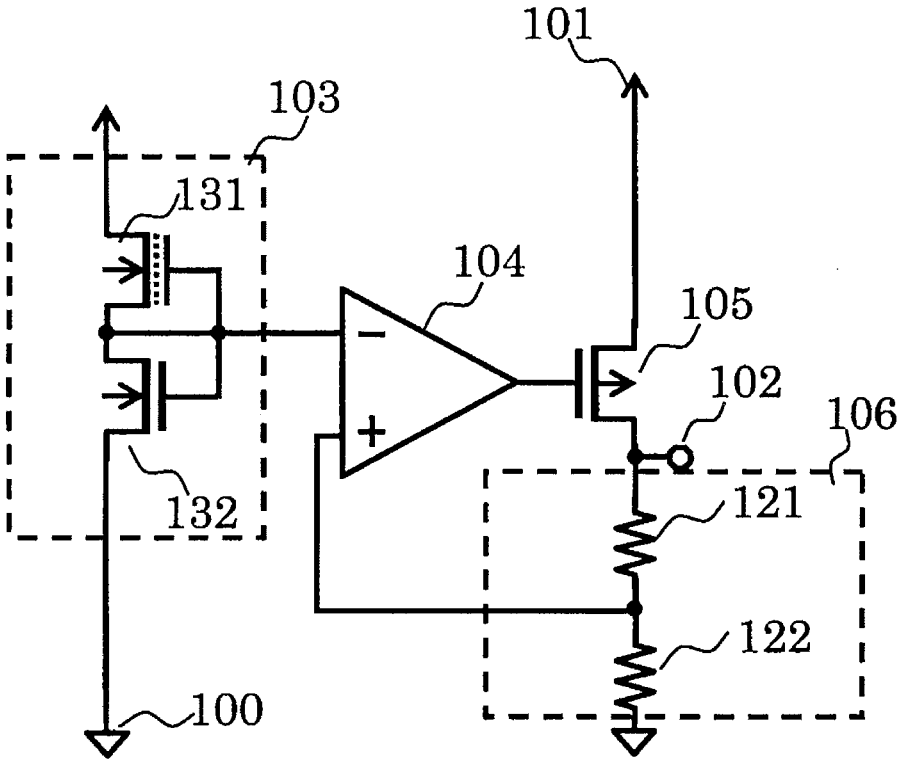
FIG. 9 PRIOR ART
FIG. 9 is a circuit diagram illustrating a related-art voltage regulator.

For example, constant current circuits 403 and 203 have different current values, and diodes 406 and 204 have the same characteristics. Inverters 201, 202, 404, and 405 have the same characteristics. The difference between the current values of the constant current circuits 403 and 203 generates a difference between a voltage across both ends of the diode 406 and the voltage across both ends of the diode 204, to thereby generate a difference in temperature to be detected. Thus, the two outputs of the temperature detection circuit 111 each output a signal Low at different temperatures. Therefore, the NMOS transistor 124 and an NMOS transistor 402 of the voltage divider circuit 112 can be turned off at different temperatures, and hence the output voltage VOUT can be corrected step-by-step with respect to temperature. In this way, the conditions of Expression (2) and Expression (3) are satisfied, and a temperature change of the output voltage VOUT occurring at high temperature can be reduced as shown in FIG. 8D.

Note that, in FIG. 5, the two resistors connected in parallel to the NMOS transistors of the voltage divider circuit 112 are used, but the number of the resistors is not limited to two and three or more resistors may be connected in series. Further, the reference voltage circuit and the temperature detection circuit may have any configuration without limitation as long as the operation of the present invention is achieved.

As described above, according to the voltage regulator of the second embodiment, at least two resistors are connected in parallel to the NMOS transistors of the voltage divider circuit 112, and the outputs of the temperature detection circuit 111 have a difference in detection temperature. In this manner, at high temperature, the resistance value of the voltage-dividing resistor connected to the output terminal 102 can increase step-by-step to increase the output voltage VOUT step-by-step. Thus, the accuracy of the output voltage VOUT can be kept within a certain range.

Figure 6:
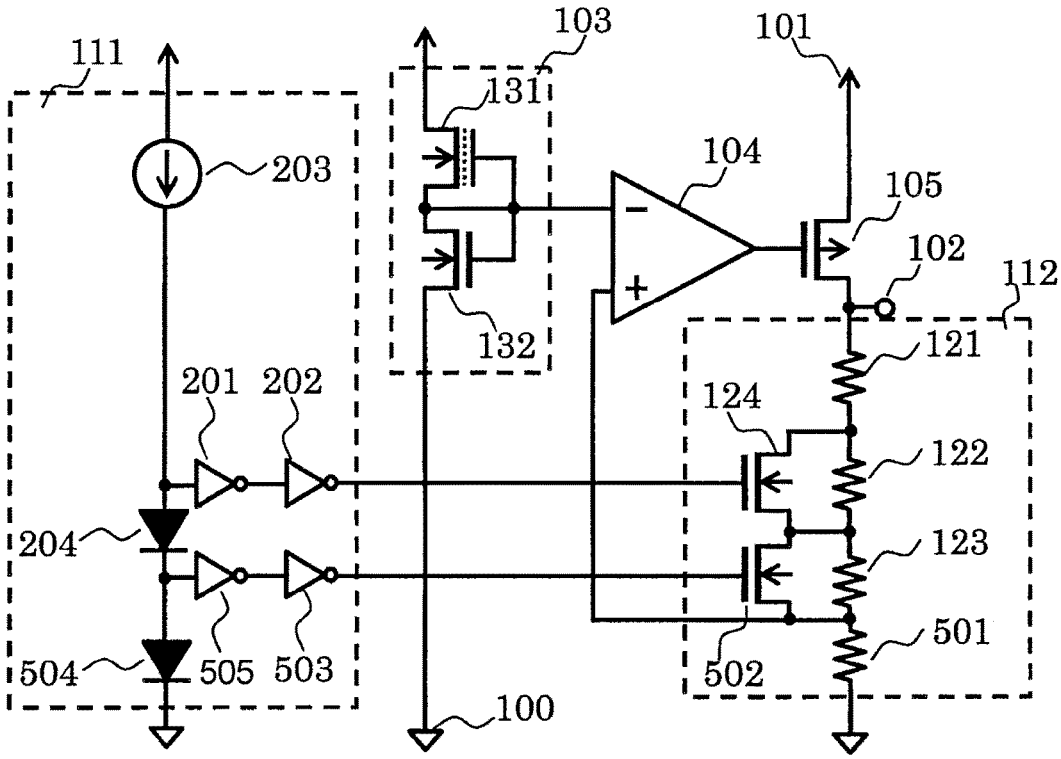
FIG. 6 is a circuit diagram illustrating another example of the voltage regulator of the second embodiment.

FIG. 6 is a circuit diagram illustrating another example of the voltage regulator of the second embodiment. A voltage regulator of FIG. 6 differs from the voltage regulator of FIG. 5 in that the temperature detection circuit 111 includes the constant current circuit 203, the diode 204, and a diode 504 connected in series.

Because the temperature detection circuit 111 includes the two diodes connected in series, the voltage of the anode of the diode 204 has a negative temperature coefficient of about −4 mV. On the other hand, a voltage of the anode of the diode 504 has a negative temperature coefficient of about −2 mV. Thus, the detection temperatures can differ from each other due to the difference in temperature coefficients of the diodes. Therefore, an NMOS transistor 502 and the NMOS transistor 124 of the voltage divider circuit 112 can be turned off at different temperatures, and hence the output voltage VOUT can be corrected step-by-step with respect to temperature. In this way, Expression (2) and Expression (3) are satisfied, and the temperature change of the output voltage VOUT occurring at high temperature can be further reduced as shown in FIG. 8D. In addition, the power consumption can be lowered with the single constant current circuit.

Note that, in order to provide the difference in detection temperature, the difference in current values of the constant current circuits and the difference in temperature coefficients of the diodes are used. However, the inverters may have different thresholds instead. Further, the two resistors connected in parallel to the NMOS transistors of the voltage divider circuit 112 are used, but the number of the resistors is not limited to two and three or more resistors may be connected in series. Further, the reference voltage circuit and the temperature detection circuit may have any configuration without limitation as long as the operation of the present invention is achieved.

As described above, according to the voltage regulator of this embodiment, at least two resistors are connected in parallel to the NMOS transistors of the voltage divider circuit 112, and the outputs of the temperature detection circuit 111 have a difference in detection temperature. In this manner, at high temperature, the resistance value of the voltage-dividing resistor connected to the output terminal 102 can increase step-by-step to increase the output voltage VOUT step-by-step. Thus, the accuracy of the output voltage VOUT can be kept within a certain range.

Figure 7:
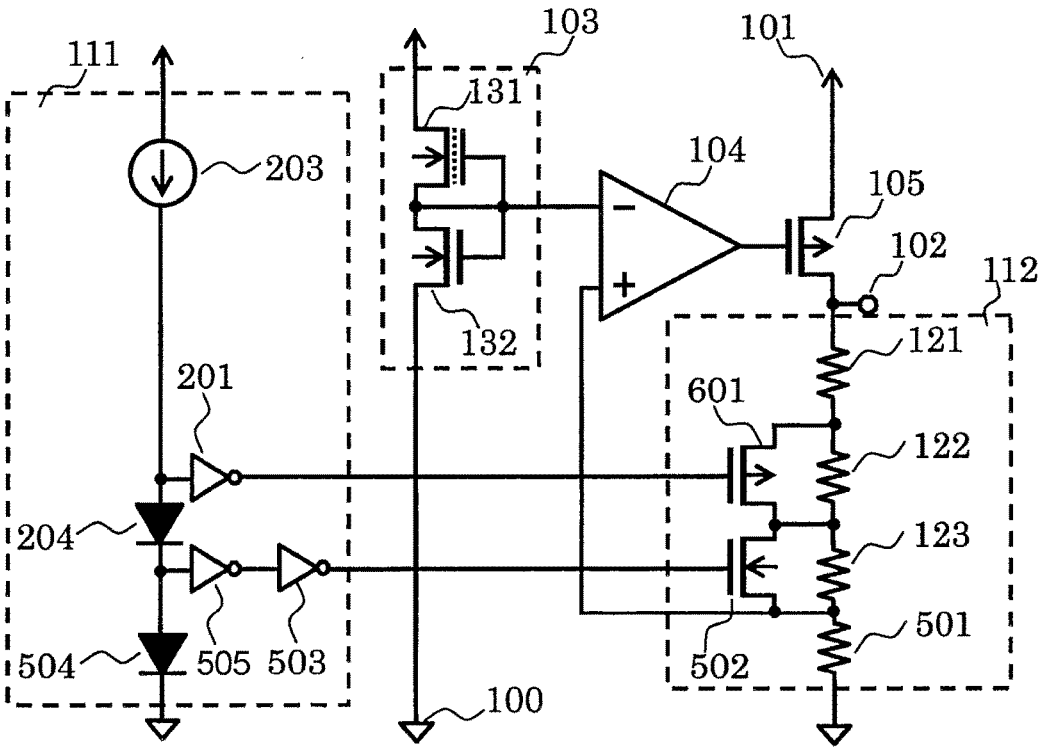
FIG. 7 is a circuit diagram illustrating still another example of the voltage regulator of the second embodiment.

FIG. 7 is a circuit diagram illustrating still another example of the voltage regulator of the second embodiment. FIG. 7 differs from FIG. 6 in that the inverter 202 is eliminated, and the NMOS transistor 124 is changed to a PMOS transistor 601.

The PMOS transistor 601 is used to cause a current to flow in such a direction that the current cancels out a junction leakage current flowing from the power supply terminal 101 via the substrate into the circuit, and a junction leakage current flowing from the inside of the NMOS transistor 502 to the ground terminal. Thus, the influence of the leakage current on the output voltage VOUT can be suppressed.

Note that, the reference voltage circuit 103 and the temperature detection circuit 111 may have any configuration without limitation as long as the operation of the present invention is achieved.

As described above, the NMOS transistor and the PMOS transistor are used as switches for the voltage divider circuit 112 for increasing the output voltage VOUT at high temperature, and it is therefore possible to cancel out leakage currents generated by the switching transistors, and increase the output voltage VOUT step-by-step with a higher accuracy. In addition, the temperature change of the output voltage VOUT occurring at high temperature can further be reduced.

As described above, the voltage regulator of the present invention includes the temperature detection circuit 111, and the voltage divider circuit 112 includes the switching transistor for inputting the output thereof. Then, the resistance value of the voltage divider circuit 112 is controlled depending on temperature. Thus, the accuracy of the output voltage VOUT can be kept within a certain range.

Note that, the circuit configuration of the present invention is not limited to the configurations of FIGS. 1 to 7, and may include an appropriate combination of the configurations.

Further, the reference voltage circuit and the temperature detection circuit may have any configuration without limitation as long as the operation of the present invention is achieved.

What is claimed is:

1. A voltage regulator, comprising:

a reference voltage circuit configured to output a reference voltage that varies with temperature;

an output transistor configured to output an output voltage;

a voltage divider circuit configured to divide the output voltage to output a divided voltage;

an error amplifier circuit configured to amplify a difference between the reference voltage and the divided voltage, and output the amplified difference to control a gate of the output transistor;

a switching circuit configured to switch the divided voltage of the voltage divider circuit; and a temperature detection circuit configured to detect a change in temperature and output a signal in accordance with the detected change in temperature to control the switching circuit to maintain the output voltage of the output transistor within a predetermined range.

2. A voltage regulator according to claim 1, wherein the voltage divider circuit comprises:

a plurality of resistors connected in series; and the switching circuit connected in parallel to the plurality of resistors.

3. A voltage regulator according to claim 1, wherein the temperature detection circuit comprises:

a constant current circuit and a resistor connected in series between a power supply terminal and a ground terminal; and a comparison circuit including an inverting input terminal connected to a node between the constant current circuit and the resistor, a non-inverting input terminal connected to the reference voltage circuit, and an output terminal connected to the switching circuit.

* * * * *